US006772798B2

(12) United States Patent
Cheung

(10) Patent No.: US 6,772,798 B2
(45) Date of Patent: Aug. 10, 2004

(54) STRAPPING TOOL

(75) Inventor: Nelson Cheung, Hoffman Estates, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 673 days.

(21) Appl. No.: 09/866,256

(22) Filed: May 25, 2001

(65) Prior Publication Data

US 2003/0037832 A1 Feb. 27, 2003

(51) Int. Cl.[7] ..... B21F 9/02
(52) U.S. Cl. ..... 140/93.2; 140/152
(58) Field of Search ..... 140/93.2, 93.4, 140/150, 152, 153

(56) References Cited

U.S. PATENT DOCUMENTS 2,621,893 A * 12/1952 Childress ..... 254/216
3,794,086 A * 2/1974 Hall et al. ..... 140/93.2
5,181,546 A * 1/1993 Synek ..... 140/93.4
5,526,852 A * 6/1996 Rakovski ..... 140/93.2
5,715,873 A * 2/1998 Figiel et al. ..... 140/152

* cited by examiner

*Primary Examiner*—Lowell A. Larson
(74) *Attorney, Agent, or Firm*—Mark W. Croll, Esq.; Donald J. Breh, Esq.; Welsh & Katz, Ltd.

(57) ABSTRACT

A strapping machine for forming a seal between two portions of strapping material includes a fixed support and a movable support movable away from and toward the fixed support to form the seal. The strapping machine includes an eccentric shaft defining primary and secondary axes of rotation, and having a key extending from an end thereof. The movable support moves about the secondary axis. An actuating lever rotates about the primary axis to move the movable support toward and away from the fixed support. A shaft securing member has a key receiving aperture for engaging the shaft key in only one orientation. The shaft securing member is fastened to the body to secure the shaft in a desired orientation. The strapping machine includes a reversible actuating lever to accommodate strapping operations in multiple orientations. A variable strap width assembly accommodates use of various strap widths.

20 Claims, 6 Drawing Sheets

STRAPPING TOOL

BACKGROUND OF THE INVENTION

The present invention pertains to an improved strapping tool. More particularly, the present invention pertains to a strapping tool that accommodates strapping material of varying widths and thickness, and facilitates operation in more than one orientation.

Strapping machines or strappers are well known in the art. The machines are used to strap together articles, e.g., a load, with strapping material. Strapping material is offered in a variety of sizes and materials and is generally stored on a roll. Conventional strapping materials include plastic and metals, such as steel. Steel strapping is typically coated with, for example paint, to inhibit corrosion.

Typically, a free end of strapping material is passed around the load until there is an overlap between the free end and the strapping material still connected to the roll. The overlapping portion of strapping material is placed between jaws of a strapping machine and the free end of the strapping material is fixed in place by a gripper portion of the machine. After the strapping material is fixed, the material is generally tightened or tensioned around the articles to a desired tension. This is accomplished by operating a feed wheel to pull back or tension the strapping material.

A typical strapping machine includes sealing heads for sealing the free end of the strapping material onto itself, around the load. Typically, in manual (i.e., hand-operated) strapping machines, a handle is rotated which applies a force to cause a punch or sealing head to engage and press down against the strap to seal the strap to itself. After the strapping material is sealed, the strapping material still connected to the roll is cut by a cutter, which is a portion of the strapper. This completes one strapping operation.

In one known type of strapper, the sealing head and the cutter are carried by a jaw assembly within the strapper. The jaw assembly includes a stationary or fixed sealing head, a movable sealing head and the cutter. The cutter moves with the movable sealing head into and out of engagement with the strap material to form the seal and cut the strap from the roll or supply. Typically, the movable portion of the jaw is actuated by rotation of an actuator handle. The handle rotates about a shaft that is positioned within the strapper body.

Although straps are typically available having standard widths and thicknesses (i.e., gauges), there are tolerances within which the strap may be supplied. This is particularly the case with respect to the strap gauge. Strap is typically available in standard thicknesses of ½ inch, ⅝ inch and ¾ inch.

To this end, strappers are required to properly function with varying thicknesses and widths of strap. Thus, whenever a "new" source of strap is supplied, such as when a new roll of strap is used, the sealing head height can require adjustment.

In one arrangement for adjusting the tool to accommodate varying thicknesses of strap, the shaft on which the actuator handle is positioned is eccentrically formed. In this manner, the portion of the handle that is positioned with the strapper body has one axis of rotation and the portion on which the jaw assembly is mounted has different axis of rotation. This permits adjusting the distance that the movable sealing head moves relative to the fixed sealing head, and thus permits adjusting the gap between the sealing heads when the heads are fully engaged.

To fix the position of the shaft, a hexagonal key extends from an end of the shaft. A plate having a key-way with a mating hexagonal opening is fitted over the key and is secured in place to the strapper body by a fastener that is inserted though a notched opening in the plate. The plate can be rotated such that the fastener rides through the notched opening to rotate the shaft for adjusting the shaft position (and thus the height of the movable sealing head).

Although this arrangement permits readily adjusting and setting the sealing head height (by rotating the shaft through 360°), because the key and key-way are hexagonal shaped, the key can fit into the key-way in any one of six positions. While this provides flexibility in adjusting the sealing head height, it also creates the possibility (and probability) that the key will be improperly set within the key way, thus improperly setting the height of the movable head relative to the fixed head.

In an arrangement for accommodating varying strap widths, one strapper uses a simple, removable stop plate against which the strap rests when it is fully inserted into the jaw assembly. In one position, the plate is configured to accommodate one width of strap, and when removed, the strapper accommodates another size of strap. Thus, only two of the three "standard" widths are accommodate by any one strapper without major reconfiguration and changes to the tool.

In addition, due to awkwardly shaped loads, it may be easier to perform strapping operations in different orientations. This is particularly so given that the strapper is often used "in the field," from locations ranging from logging sites to large indoor warehouse facilities. As such, the strapper may be operated with the jaw residing horizontally, vertically or even at an incline between the horizontal and vertical. To this end, the orientation and position of the actuating handle can be different throughout use at any given site or location.

Accordingly, there continues to be a need for a strapper machine that can be readily adjusted to accommodate strap material of varying widths and thicknesses. Desirably, such strapper accommodates strap material of varying thicknesses, such as when rolls of material are changed out, with minimal effort. More desirable, such a strapper further permits maintenance on the strapper head or jaw while maintaining a predetermined setting for the strap thickness.

Additionally, such a strapper can accommodate any of the three standard strap widths with minimal adjustment. Desirable, such a strap width adjustment is carried out by movement of parts within and part of the strap width setting assembly. Moreover, such a strapper further accommodates operation an a variety of orientations and positions so as to reduce operator fatigue and to improve leverage in operation of the actuator handle.

BRIEF SUMMARY OF THE INVENTION

A strapping machine forms a seal between two portions of strapping material and cuts an upper layer of the strapping material without impinging a lower layer of the strapping material. The strapping machine includes a strapping machine body having first and second shaft apertures formed therein. The body further includes first and second fastener apertures formed in the body adjacent one of the shaft apertures.

An eccentric shaft includes first and second shaft sections integral with one another defining primary and secondary axes of rotation. Preferably, the first shaft section defines two sections, each defining the primary axis of rotation.

The second shaft section is eccentric relative to the first shaft section, and defines the secondary axis of rotation. The axes are spaced from and parallel to one another. The shaft is positioned in the body with the first shaft sections in the shaft apertures for rotation therein. To effect the eccentricity in the shaft, the shaft sections can have equal or different diameters with different axes of rotation. A key extends from an end of the first shaft section.

The machine includes a fixed support and a movable support. The movable support includes a cutter mounted thereto and is movable away from and toward the fixed support to form the seal and cut the upper layer of strapping material. The movable support is movable toward the fixed support to a define desired clearance therebetween.

An actuating lever is rotatable about the eccentric, second shaft section. The actuating lever is operably connected to the movable support for moving the movable support toward and away from the fixed support.

A shaft securing member has a key receiving aperture that is configured for engagement with the shaft key in only one orientation. The shaft securing member is fastened to the body to secure the shaft in a desired orientation. The securing member has at least one fastener opening therein for alignment with one of the first and second apertures in the strapping machine body.

The shaft is rotated to a position to set the desired clearance between the movable and fixed supports. The shaft securing member is engaged with the shaft and is fastened to the strapping machine body to secure the shaft at that rotated position. The shaft is removable from the body and replaceable only at that rotated position.

In a present embodiment, shaft key has a square shape having a corner removed, and the key receiving aperture has a corresponding square shape having a corner removed.

The shaft securing member can be formed as a wedge-shaped plate that fastens to the machine body. The key receiving aperture can be formed at about an apex of the plate. The shaft securing member fastener opening can be formed as an elongated opening or slot. Preferably, the fastener opening can be formed as an elongated opening having an arcuate shape having a focus at the key receiving aperture.

Alternately, the shaft securing member fastener opening is formed as a series of adjacent fastener openings formed as a series of adjacent fastener openings lying along an arcuate path having a focus at the key receiving aperture.

The actuating lever can include a pivot portion and a reversible handle. The handle has a straight segment and an angled segment. The reversible handle is removably connected to the pivot portion and can be secured to the pivot portion in a first orientation in which the angled segment extends in a first direction and a second orientation opposite the first orientation. The handle can be secured to the pivot portion by fasteners.

The strapping machine can further include a variable strap width accommodating assembly. The variable width assembly includes outside and inside guides to secure and hold the strapping material between the fixed and movable supports during the sealing and cutting operation.

The outside guide includes first and second guide elements pivotally connected to one another. The outside guide is removably connected to the strapping machine body. The first and second guide elements have different thicknesses relative to a plane defined generally by the strapping material between the fixed and movable supports. The outside guide elements are configured to pivot so that one is positioned in a depending orientation relative to the other.

An inside guide is mounted to the strapping machine body intersecting the strapping material plane. The depending outside guide element guide is moveable into the strapping material plane to abut the strapping material and position the strapping material between the inside and outside guides when the movable support is moved toward the fixed support for forming the seal.

In a present configuration, the outside guide first and second elements are pivotally mounted to one another by a pivot pin. The entire outside guide is mounted to the strapping machine body by the pivot pin.

The non-depending outside guide element is positioned in a longitudinal orientation relative to the depending guide element. The longitudinally oriented element is further mounted to the strapping machine body by a pin connecting the longitudinal guide element to the strapping machine body to secure the outside guide to the body.

The inside guide defines first and second guide edges and is connected to the strapping machine body at a point of connection. The point of connection is a first distance from the first guide edge and a second distance from the second guide edge, different from the first distance.

Apertures are formed in the inside guide and the strapping machine body at the point of connection. A fastener secures the guide to the strapping machine body.

Advantageously, the inside and outside guides are independently positionable on the strapping machine body. To this end, the machine accommodates at least three different strapping material widths.

Other features and advantages of the present invention will be apparent from the following detailed description, the accompanying drawings, and the appended claims.

BRIEF DESCRIPTION OF THE FIGURES

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
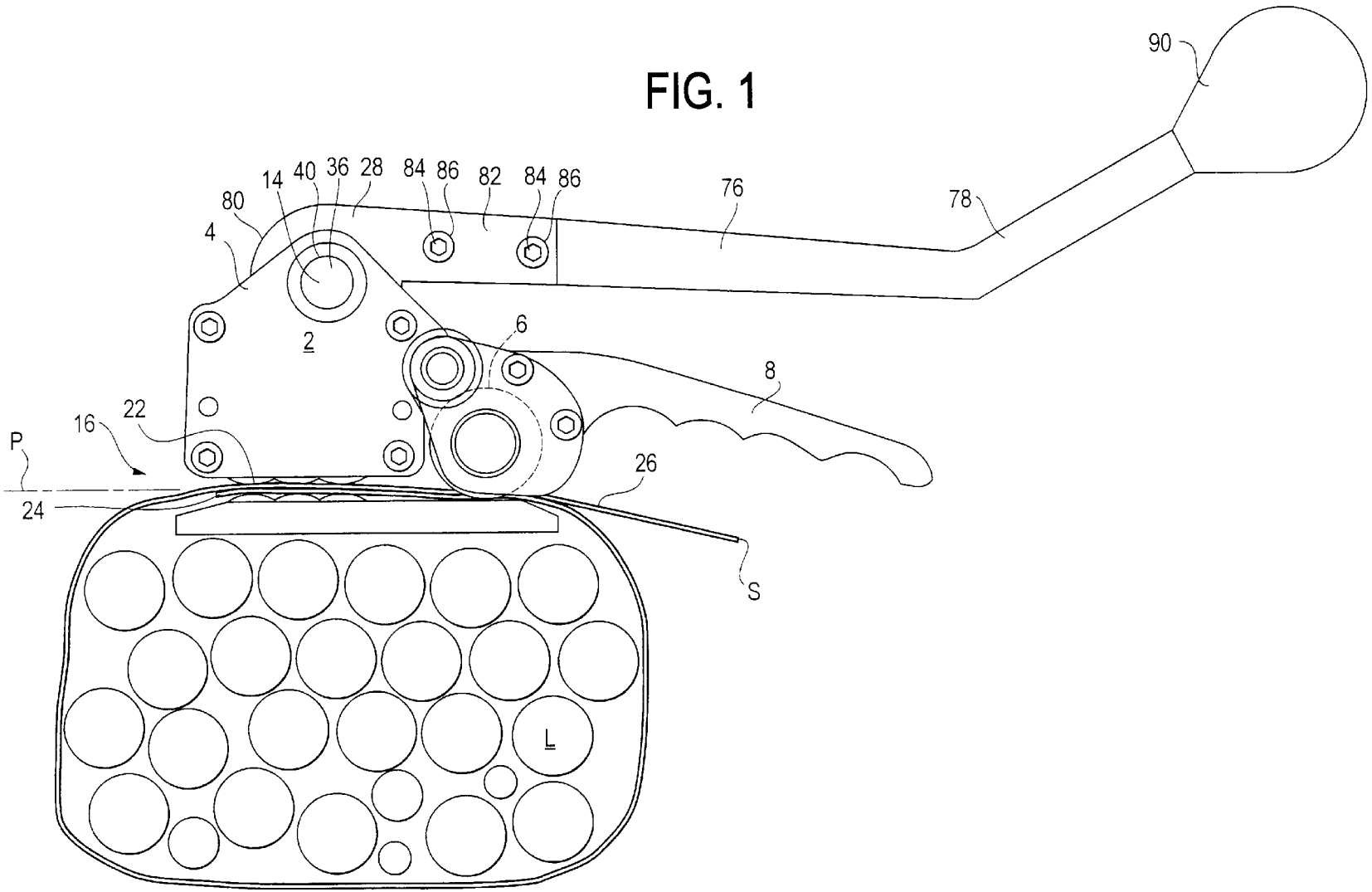
FIG. 1 illustrates a front view of an exemplary improved strapping machine or strapping tool embodying the principles of the present invention, the illustrated tool is shown including a reversible actuating handle and an eccentric shaft on which the handle and the jaw assembly are mounted.

While the present invention is susceptible of embodiment in various forms, there is shown in the drawings and will hereinafter be described specific embodiments with the understanding that the present disclosure is to be considered an exemplification of the invention and is not intended to limit the invention to the specific embodiments illustrated. It should be further understood that the title of this section, normally, "Detailed Description of the Invention," relates to a requirement of the United States Patent and Trademark Office, and does not imply, nor should be referred to limit the subject matter disclosed and claimed herein.

The invention may be used in a variety of strapping machines or strapping tools (also referred to as strappers) such as the exemplary strapper 2 illustrated in FIG. 1. The illustrated strapper 2 includes a strapping machine body 4, a gripper (not shown), feed wheel 6 and accompanying feed lever 8. The illustrated strapper 2 further includes a cutter 10 (FIG. 2) and accompanying actuating lever 12, which is configured to rotate about an eccentric shaft 14.

A jaw assembly 16 is operably connected to the shaft 14 and actuating lever 12, as will be described below. The jaw assembly 16 includes movable and fixed supports 18, 20, respectively. Sealing elements 22 are carried by the supports 18, 20. Those skilled in the art will recognize and appreciate the various strapping machines that may include different embodiments of grippers, feed wheels and/or accompanying levers and cutters, or other structures used to grip a strap, tension a strap around a load and cut the strap.

In a typical use, a first end of strapping material (S), which can be stored on a roll, is passed around a load L and fed into the jaw assembly 16, between the movable and fixed supports 18, 20 and gripped by the gripper. This results in an overlap of strapping material S so the first end, which is gripped by the gripper, forms a lower layer of strapping material 24. An upper layer of strapping material 26, which is still connected to the roll, overlaps the lower layer 24. The feed wheel 6 and the accompanying feed lever 8 are then operated to tighten the strap around the load L. The strap S, which defines a plane, generally indicated P in FIG. 1, is then sealed to itself and cut by the cutter 10.

Figure 2:
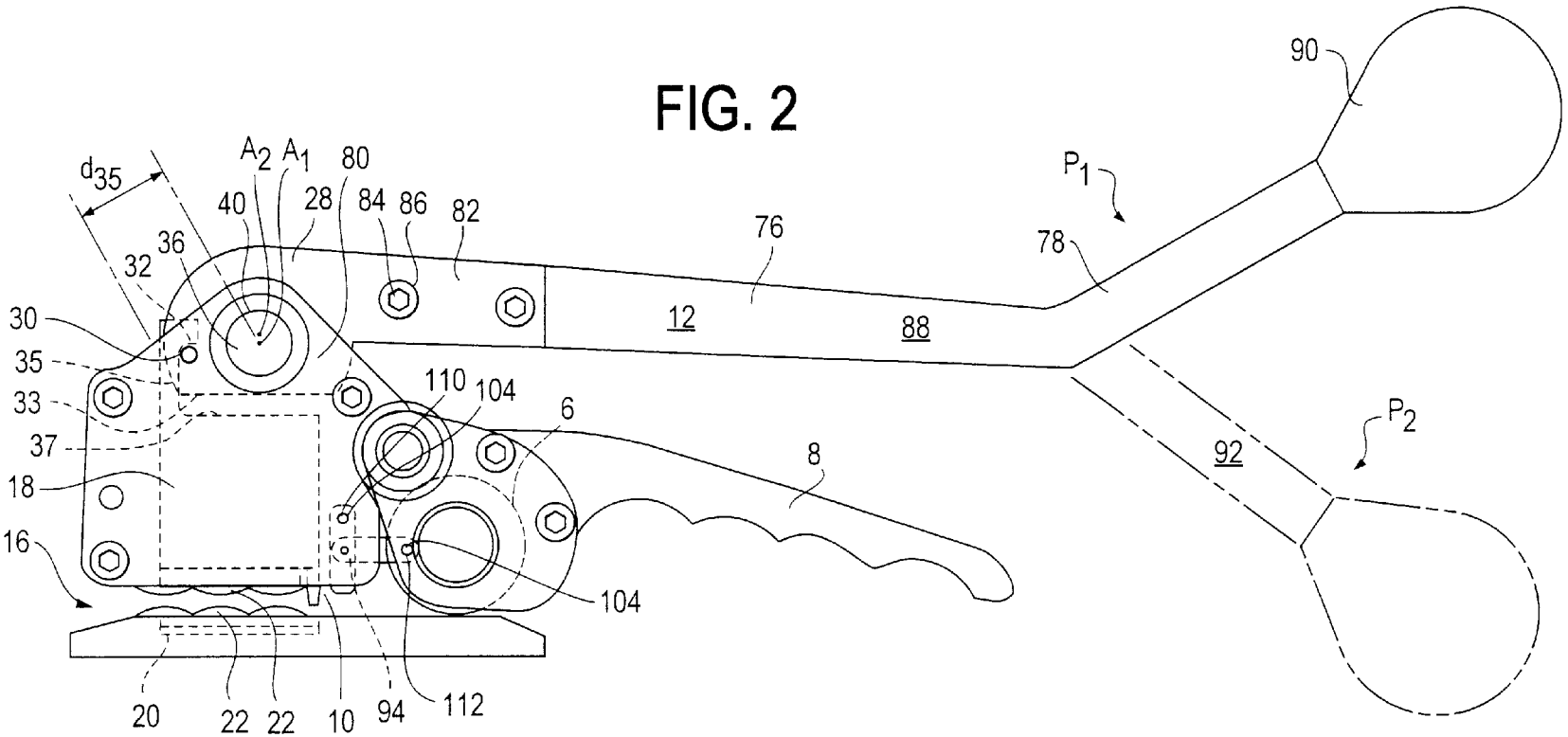
FIG. 2 illustrates the exemplary strapping tool of FIG. 1 in which the actuating handle is shown in a first position as in FIG. 1 and is shown in a reversed position in phantom lines, the tool further shown with an outside strap width guide mounted therein.

A seal is formed in the strapping material S, between the upper layer 26 of the strap and the lower layer 24 by rotating the actuating lever 12, which will cause the movable support 18 to move downwardly toward the fixed support 20 with the strap S therebetween, as shown in FIG. 1. Referring now also to FIG. 2, this causes the sealing elements 22, which are attached to the movable support 18, to seal the upper layer of strap material 26 into the lower layer of strap material 24. This also causes the cutter 10 to engage and cut the upper layer of strapping material 26 from the roll.

The cutter 10 is mounted to the movable support 18, which, in turn is operably connected to the actuating lever 12, by a connector 28. In the illustrated embodiment, the connector 28 includes a pin 30 formed on the actuating handle 12, spaced from the handle's axis of rotation, and a hook 32 formed on the movable support 18. The hook 32 and the pin 30 cooperate with one another such that rotation of the handle 12 (as seen in FIG. 2) lifts the movable support 18 upward, away from the fixed support 20. The actuating lever 12 rotates about the eccentric shaft 14, as will be described below.

Other connector 28 configurations that provide for translation of rotational movement into linear or near linear movement will be recognized by those skilled in the art, and are within the scope and spirit of the present invention, such as variations of the illustrated, exemplary pin and hook configuration.

As seen in FIG. 2, the connector 28 includes a flat surface 33, contiguous with a curved or arcuate camming surface 35. As the handle 12 is rotated, the camming surface 35 contacts a bearing surface 37 of the movable support 18, urging the support 18 downwardly (to the fixed support 20), a distance that is equal to the radial distance $d_{35}$ from the camming surface 35 to the primary axis of rotation $A_1$, described below.

When strapping material of different thickness is used, the initial height of the cutter 10 is adjusted to ensure that the cutter 10 does not impinge the lower layer of strapping material 24 during cutting operation. This is to reduce the potential for impinging the lower layer of strapping material 24 which can affect the integrity of the strap used to bind the load together.

In the illustrated strapper 2, the cutter 10 height is adjusted by rotating the eccentric shaft 14. Because the cutter 10 is fixedly mounted to the movable support 18, rotating the eccentric shaft 14 varies the radial distance $d_{35}$ from the camming surface 35 to the primary axis of rotation $A_1$.

Figure 3:
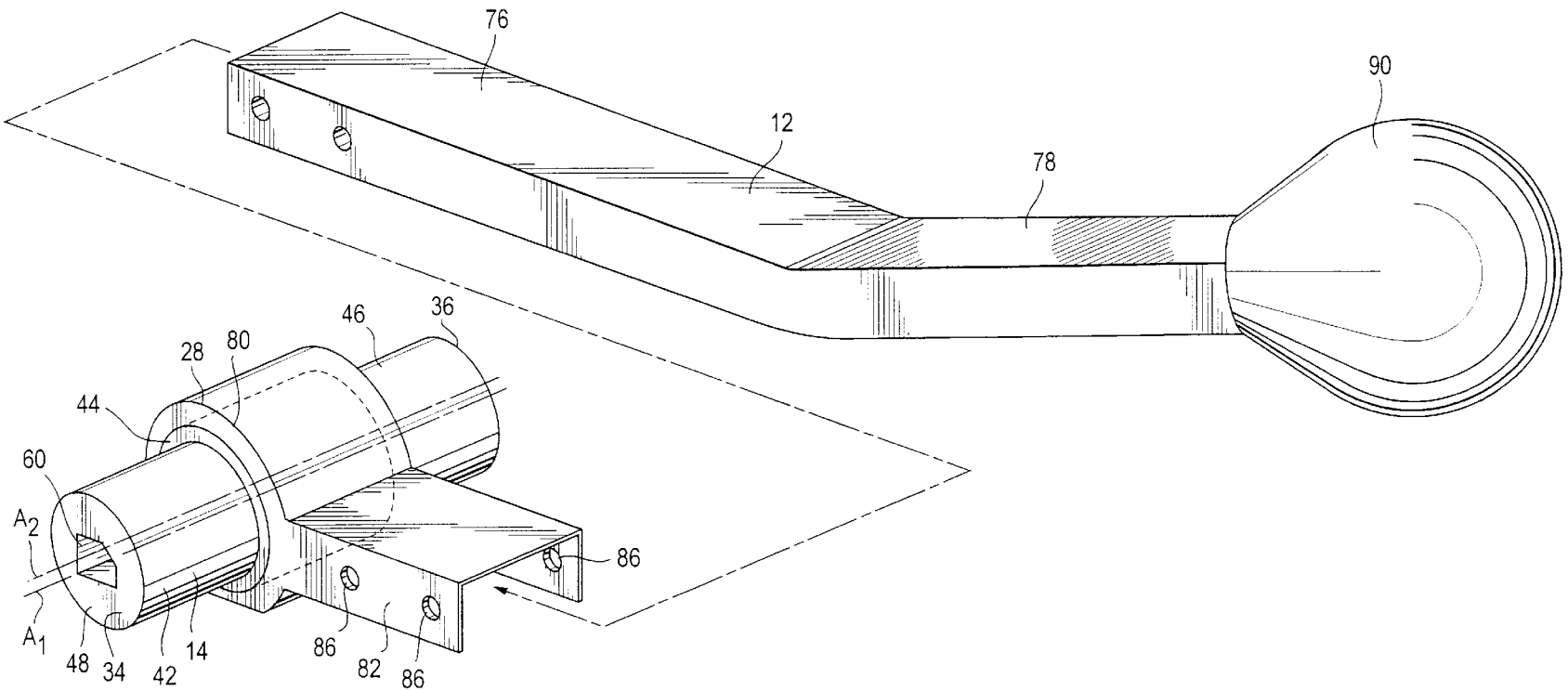
FIG. 3 illustrates an eccentric shaft with a connector configured to rotate about a portion of the eccentric shaft, and a reversible actuating handle configured to cooperate with the connector pursuant to principles of the present invention.
Figure 4:
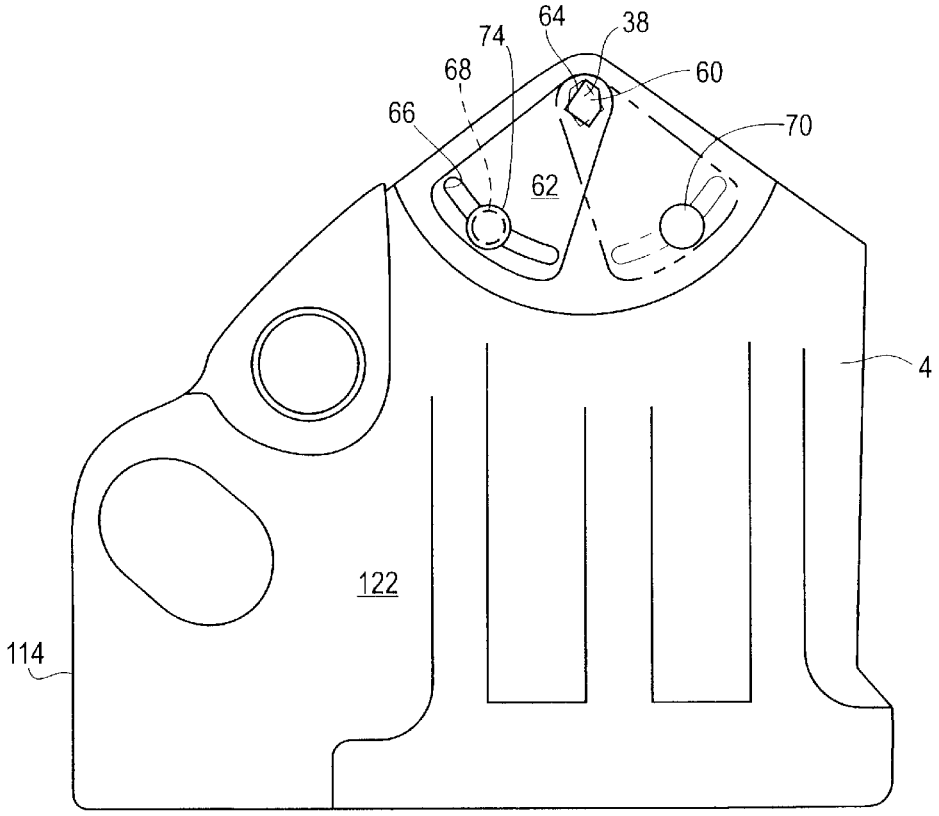
FIG. 4 is a rear view of the strapping tool body (relative to FIG. 1) showing the shaft key, and key-way and shaft securing plate, the body having fastener apertures formed therein for securing the plate to the body, and further illustrates two exemplary positions in which the plate is secured to the body to lock the position of the key and shaft.

The shaft 14 operably connects the handle 12 to the strapper body 4 and the jaw assembly 16, including the cutter 10. The ends 34, 36 of the eccentric shaft are positioned within shaft apertures 38, 40 formed within the body 4 in a manner that allows for the shaft 14 to rotate, as shown in FIGS. 2–4. The illustrated eccentric shaft 14 is formed having three shaft sections 42, 44, 46 that are integral with one another.

The first shaft section 42 has a first end 48. The first and third or outer sections 42, 46 have a common axis of rotation $A_1$, which defines the first or primary axis of rotation. The second or central shaft section 44 is eccentric relative to the outer sections 42, 46, and thus defines the second or secondary axis of rotation $A_2$ that is parallel to and spaced from the primary axis $A_1$.

As can be seen from FIG. 2, the outer shaft sections 42, 46 are positioned and rotate within the strapper body 4, while the central shaft section 44 resides within the handle aperture, and provides a pivot, i.e., an axis of rotation $A_2$, for the handle 12. To this end, because the handle 12 rotates about the central section 44, the location of the handle 12 axis (the secondary axis $A_2$) moves or shifts relative to the body 4 and the fixed support 20 as the shaft 14 is rotated.

The connector 28 (and thus the movable support 18) is operably connected to the handle 12. Thus, rotating the shaft 14 shifts the height of the connector 28 relative to the body 4 and support 18. In that the cutter 10 is fixedly mounted to the movable support 18, and in that the movable support 18 moves downwardly to the fixed support 20 only as far as it is urged by contact of the camming surface 35, rotation of the connector 28 (by rotating the handle 12) varies the radial distance $d_{35}$ that the movable support 18 (and attached cutter 10) are moved relative to the fixed support 20. Thus, rotating the shaft 14 shifts or varies the height of the cutter 10 relative to the fixed support 20.

FIGS. 1–4 show the first and second ends 34, 36 of the shaft 14 positioned in the first and second shaft apertures 38, 40. The first end 34 shaft 14 has a shaped protrusion or key 60 formed thereon.

A locking plate 62 is used to lock the position of the shaft 14 relative to the body 4. Referring to FIG. 4, the plate 62 includes a key-way 64 formed as an aperture that corresponds to the key 60 on the shaft end 34 the cooperate with one another to lock the shaft into a desired position.

Figure 4A:
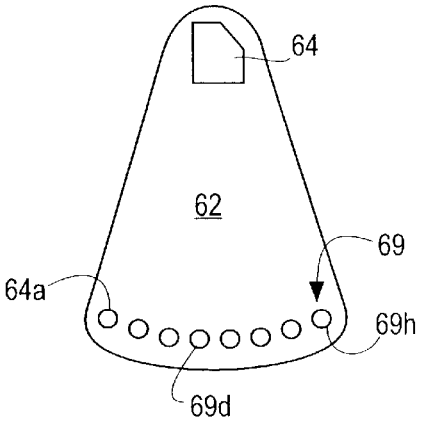
FIG. 4A illustrates an alternate shaft securing plate.

The plate includes a second aperture formed as a notched opening as indicated at 66 or as a series of circular openings, as indicated at 69*a–h* in FIG. 4A, that cooperate with one of a plurality of fastener apertures 68, 70 formed within the strapper body 4. A fastener is inserted though the second aperture 66 and into one of the fastener apertures 68, 70 to lock the plate 62 and, consequently, the shaft 14 in a selected position. As set forth above, rotating the shaft shifts the position or height of the movable support 18 and thus the cutter 10 relative to the fixed support. Thus, locking the shaft 14 at a particular position locks the relative height of the cutter 10.

That is, because the handle 12 pivots about the eccentric portion 44 of the shaft 14, as the shaft 14 is rotated, the distance between the camming surface 35 and the fixed support 20 varies. Because the height of the movable support 18 is fixed, the depth or distance into which the moveable support 18 is urged into the fixed support 20 varies with rotation of the shaft 14. Thus, locking the plate 62 locks the cutter 10 starting height into one position because the initial cutter 10 height is established by the position of the eccentric shaft 14.

Referring now to FIG. 4, the fastener arrangement in conjunction with the pair of apertures 68, 70 openings in the body 4 and the opening 66 slotted (or series of circular openings 69) in the plate 62 provides a wide range over which the shaft 14 can be locked into a desired position. Although the illustrated embodiment shows a threaded fastener inserted into and threadedly engaging the body 4, other configurations for this arrangement will be recognized by those skilled in the art and are within the scope and spirit of the present invention.

Typically, manual strapping machines are used to strap several groups of articles together at, for example, a remote location, site or as another example, at a warehouse facility. At these sites, strapping machine disassembly may be required for service to, for example, dislodge an errant piece of strap that has become lodged in the tool. In many instances, the strap supply need not be changed, and as such, it is desirable to maintain the height at which the cutter has been set. To this end, during disassembly, the plate 62 is generally kept in place and the eccentric shaft 14 is removed to perform the required maintenance.

During reassembly, the key 60 is reinserted into the plate 62 to fit into or cooperate with the shaped aperture 64. In known strapping tools, the keys and apertures permit replacing the shaft in a position other than the original position prior to disassembly. For example, in one known strapping tool a hexagonal key is fitted into a corresponding hexagonal aperture. Thus, because the key can be replaced in any of six different ways into the aperture, the potential, and in fact likelihood of improperly replacing the shaft is quite great. This inevitably results in a loss of valuable operator time and may also result in faulty strapping tool operations (if the lower layer of the strap is impinged or cut while in use because of a faulty key position).

Referring now to FIG. 4, the key 60 on the shaft, as it fits into the plate aperture 64 permits replacement in only one orientation. In a present embodiment, the key 60 has a square shape having a corner removed to form an irregular, five-sided shape. The aperture 64 has a corresponding shape so that the key is received by the plate 62 in only one orientation. Those skilled in the art will recognize that other shaped keys and apertures can be used that permit the shaft to be replaced in only one position, such as, for example, any irregular shape including non-equilateral triangles, five cornered rectangles, or other non-symmetrical polygons.

As set forth above, the slotted opening 66 (or series of circular openings 69) and the number of fastener apertures 68, 70 can be varied to increase the number of positions into which the key 62 can be locked into the plate to provide essentially a 180 degree range over which the shaft 14 can be locked into place. The variation in the placement, number and orientations of these cooperating openings will be recognized by those skilled in the art and is within the scope and spirit of the present invention.

Referring now to FIGS. 1–2, a reversible actuating lever 12 permits strapping machine 2 operation in multiple orientations. Often times, due to awkwardly shaped loads, it may be easier to perform strapping operations by positioning the strapping machine 2 along a side of the load, rather than atop the load. Strapping along a side of the load or in other orientations, however, may be cumbersome, and may prevent use of maximum leverage to rotate the handle 12.

The reversible actuating lever 12 allows a user to apply a force to the actuating lever in both horizontal and vertical orientations with greater ease. The reversible actuating lever 12 shown in FIG. 1 has a straight segment 76 and an angled segment 78. Referring to FIG. 3, the straight segment 76 is removably connected to connector 28, which includes a circular portion 80 and a straight portion 82. The circular portion 80 is configured to pivot about the eccentric shaft portion 44. The straight segment of the connector 82 extends from the circular portion 80 and is removably connected to the straight segment of the actuating lever 76 by fasteners 84 inserted through apertures 86 formed therein. The fastener arrangement can include, for example, threaded bolts and the like. Alternately, the fastener can be of a clamp-like configuration that holds the two sections 76, 82 together. Those skilled in the art will recognize the various other fastener arrangements that can be used for joining these sections of the lever 12.

The reversible lever 12 of FIG. 2 has two positions $P_1$, $P_2$. In a first position $P_1$, a first side of the lever 88 faces outward and a handle of the lever 90 points upward whereas a second side of the lever 92 faces outward and the handle 90 points downward in a second position $P_2$. To change lever 12 positions, fasteners 84 that connect the straight segments of the actuating lever and connector 76, 82 to each other are removed to remove the actuating lever 12. The lever 12 is then "flipped" around and the fasteners 84 replaced.

Those skilled in the art will recognize that in other embodiments, the reversible actuating lever and connector can be configured to have an infinite number of positions depending on the cross-sectional shape of the actuating lever and connector. For example, the actuating lever a circular cross section with an O-ring clamp configuration could permit adjustment in numerous positions. These other shapes are within the scope and spirit of the present invention.

Figure 6A:
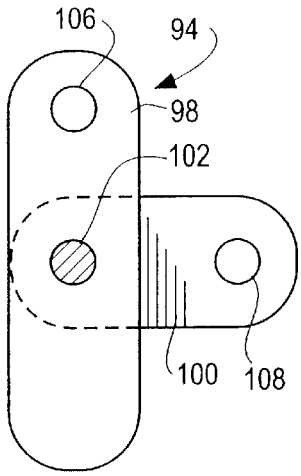
FIGS. 6*a–c* illustrate different positions of the outside guide of FIGS. 2 and 5.
Figure 6B:
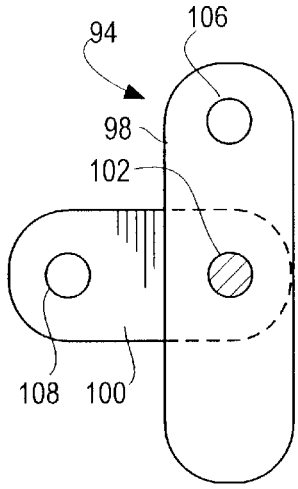
Figure 6C:
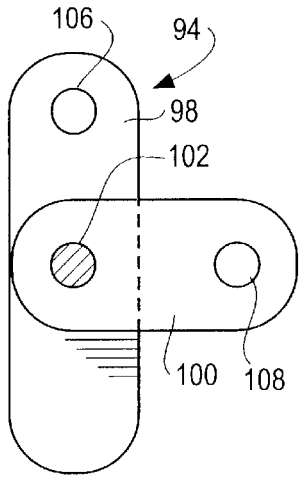
Figure 7:
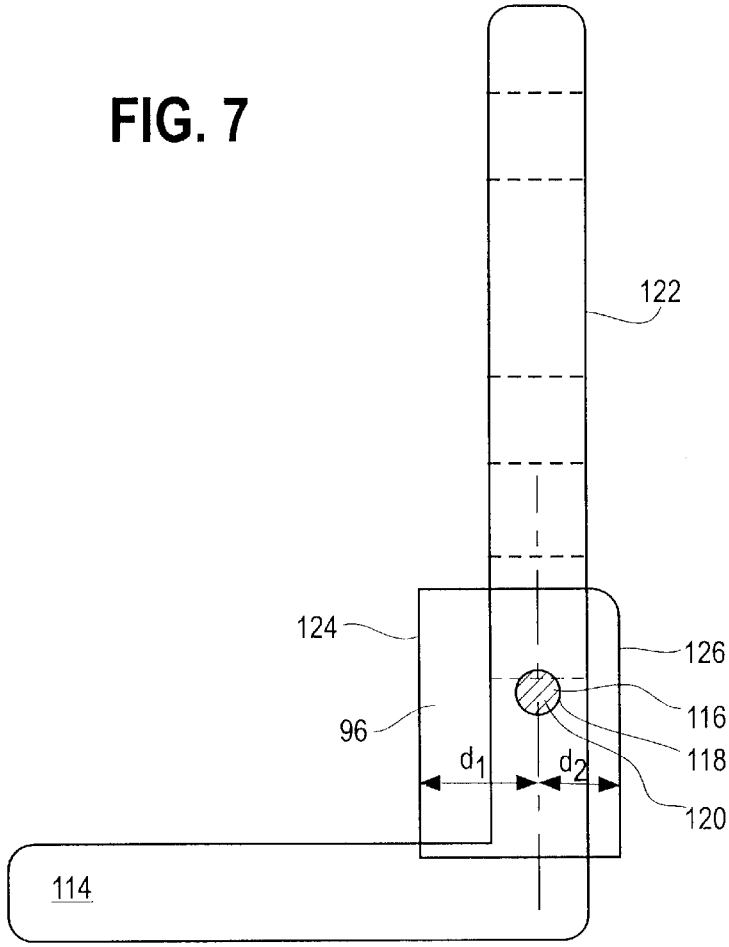
FIG. 7 illustrates the inside guide removably connected to a rear portion of the machine body of FIG. 4 pursuant to principles of the invention.

As set forth above, three different standards of strap width, namely ½ inch, ⅝ inch and ¾ inch, are presently in use. However, known strapping tools cannot accommodate these three different widths without major changes to the tool. Referring to FIGS. 2 and 5–7, the present strapper 2 includes adjustable outside and inside guides 94, 96 to accommodate these three different strap widths. As seen in FIG. 6*a*, the outside guide 94 is shown in a first position and includes a first guide element 98 pivotally connected to a second guide element 100 by a pin 102. The first and second guide elements can have differing lengths and thickness or have the same lengths and thickness in alternate embodiments. The inside guide 96 of FIG. 7 is a formed as a plate.

The outside guide 94 shown in FIG. 2, shows the outside guide 94 connected to the strapping machine body 4 by two fasteners 104. As shown in FIGS. 6*a–c*, a first aperture 106 is formed in the first guide element 98 and a second aperture 108 is formed in the second guide element 100. Further, first and second holes 110, 112 are formed in the strapping machine body 4. The first aperture and first hole 106, 110 receive a fastener 104 and the second aperture and second hole 108, 112 receive a second fastener 104 as shown in FIG. 2.

To adjust the outside guide 94, fasteners 104 and outside guide 94 are removed, and the second guide element 100 is rotated 180 degrees, as shown in FIG. 6*b*. The outside guide 94 is the rotated so that the second guide element 100 is on top and the first guide element 98 is on the bottom, as shown in FIG. 6*c*. The outside guide 94 is then reconnected in a second position to the strapping machine body 4.

An inside guide 96 is shown in FIG. 7. In the illustrated embodiment, the inside guide 96 is shown connected to a back end of the strapping machine body 114 at a point of connection aperture 116 formed within the inside guide 96 and a point of connection bore 118 formed within the back end 114 of the machine body 4 by a fastener 120. In FIG. 7, the back end 114 of the strapping machine body 4, a posterior side 122 of which is shown in FIG. 4, is illustrated with other elements of the strapping machine 2 removed for ease of illustration.

The inside guide 96 of FIG. 7 is a plate defined by a substantially rectangular shape and the point of connection aperture 116 is formed along a vertical axis V of the inside guide 96. The distance $d_1$ from the axis V and a first side 124 of the inside guide 96 is different from the distance $d_2$ between the axis V and a second side 126 of the inside guide 96, which is opposite the first side 122. Those skilled in the art will recognize that the inside guide 96 can be defined by various shapes and be connected to the strapping machine body 4 at various locations and in various manners. To adjust the inside strapping guide 96, the user can loosen the fastener 120, and rotate the inside guide 96.

Figure 5:
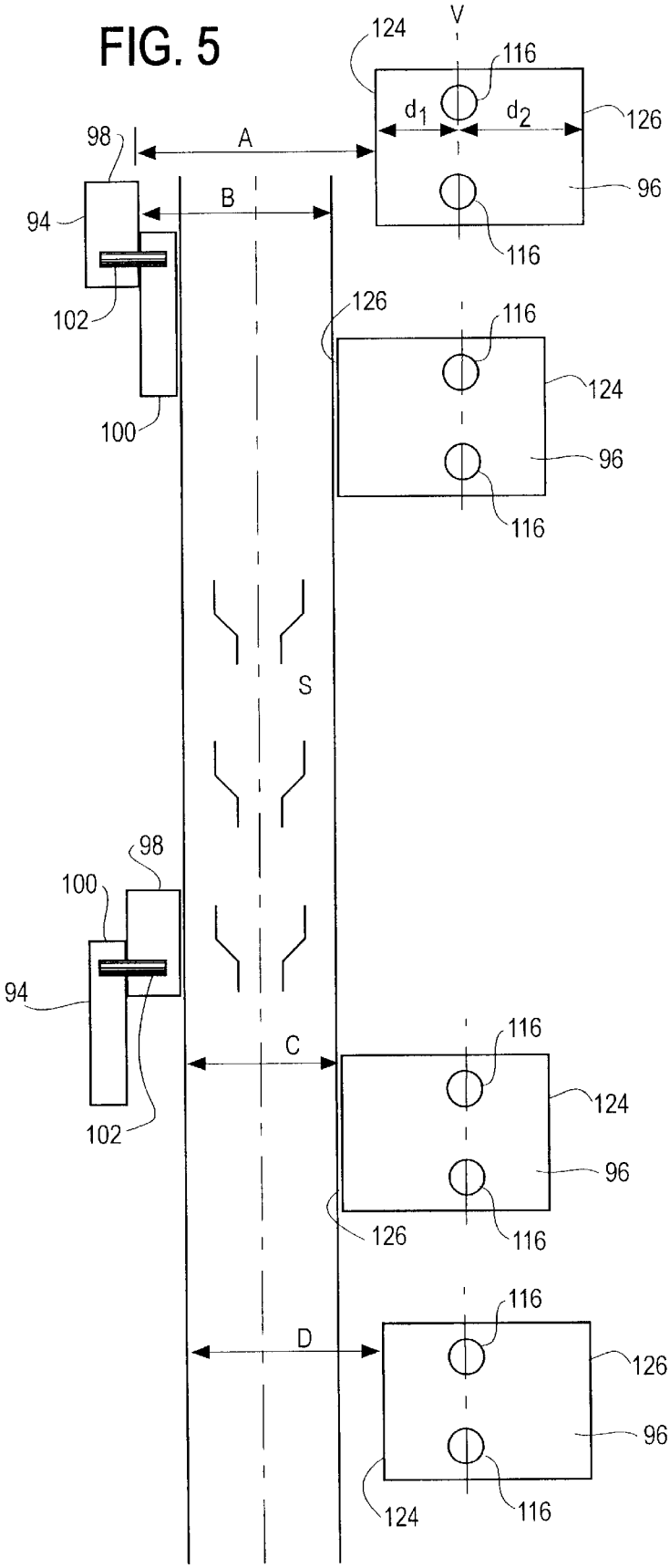
FIG. 5 illustrates a top view of an inside strap width guide in different positions and a front view of the corresponding outside strap width guide positions, and further illustrates the manner in which the inside and outside width guides cooperate with one another for accommodating differing strap widths.

As shown in FIG. 5, the inside and outside guides 94, 96 can accommodate straps of three different widths. For example, the outside guide 94 may be in a first position and accommodate straps of two widths (A, B) when the inside guide 96 is in first and second positions. Further, the outside guide 94 may be in a second position and accommodate straps of two different widths (C, D) when the inside guide 96 is in the first and second positions. It is, however, anticipated that two of the widths (e.g., widths B and D) are equal to one another, thus accommodating three different strap widths.

From the foregoing it will be observed that numerous modifications and variations can be effectuated without departing from the true spirit and scope of the novel concepts of the invention. It is to be understood that no limitation with respect to the specific embodiment illustrated is intended or should be inferred. The disclosure is intended to cover by the appended claims all such modifications as fall within the scope of the claims.

What is claimed is:

1. A strapping machine for forming a seal between two portions of strapping material and cutting an upper layer of the strapping material without impinging a lower layer of the strapping material, comprising:

a strapping machine body having a shaft aperture formed therein, the body further including first and second fastener apertures formed in the body adjacent the shaft aperture;

an eccentric shaft including first and second shaft sections integral with one another, the first shaft section defining a primary longitudinal axis of rotation, the second shaft section being eccentric relative to the first shaft section, and defining a secondary axis of rotation spaced from and parallel to the primary axis of rotation, the first shaft section being positioned in the shaft aperture for rotation therein, the first shaft section having a key extending from an end thereof;

a fixed support and a movable support, the movable support including a cutter mounted thereto, the movable support being movable away from and toward the fixed support to form the seal and cut the upper layer of strapping material, the movable support being movable toward the fixed support to a define desired clearance therebetween;

an actuating lever rotatable about the eccentric, second shaft section, the actuating lever being operably connected to the movable support for moving the movable support toward and away from the fixed support; and a shaft securing member having a key receiving aperture therein configured for engagement with the shaft key in only one orientation, the shaft securing member being fastenable to the body to secure the shaft in a desired orientation, the shaft securing member having at least one fastener opening therein for alignment with one of the first and second apertures in the strapping machine body for receiving a fastener therethrough, wherein the shaft is rotated to a position to set the desired clearance between the movable and fixed supports and wherein the shaft securing member is engaged with the shaft and the strapping machine body to secure the shaft at that rotated position, and wherein the shaft is removable from the body and replaceable only at that rotated position.

2. The strapping machine in accordance with claim 1 wherein the shaft has a third shaft section coaxial with the first shaft section and wherein the strapping machine body defines a second shaft aperture for receiving the third shaft section.

3. The strapping machine in accordance with claim 1 wherein the shaft key has a square shape having a corner removed, and wherein the key receiving aperture has a corresponding square shape having a corner removed.

4. The strapping machine in accordance with claim 2 wherein the first and third shaft sections have the same diameter.

5. The strapping machine in accordance with claim 2 wherein the second shaft section has a diameter equal to a diameter of one of the first and third shaft sections.

6. The strapping machine in accordance with claim 2 wherein the second shaft section has a diameter that is different than a diameter of the first and third shaft sections.

7. The strapping machine in accordance with claim 1 wherein the shaft securing member is formed as a plate, the key receiving aperture being formed at about an apex of the plate.

8. The strapping machine in accordance with claim 1 wherein the shaft securing member fastener opening is formed as an elongated opening.

9. The strapping machine in accordance with claim 7 wherein the shaft securing member fastener opening is formed as an elongated opening having an arcuate shape, the arcuate shape having a focus at the key receiving aperture.

10. The strapping machine in accordance with claim 1 wherein the shaft securing member fastener opening is formed as a series of adjacent fastener openings.

11. The strapping machine in accordance with claim 7 wherein the shaft securing member fastener opening is formed as a series of adjacent fastener openings lying along an arcuate path, the arcuate path having a focus at the key receiving aperture.

12. A strapping machine for forming a seal between two portions of strapping material, comprising:

a strapping machine body;

a jaw assembly having a fixed portion fixedly mounted to the strapping machine body and a movable portion movable away from and toward the fixed portion for engaging the two portions of strapping material therebetween and forming the seal; and an actuating lever operably connected to the movable portion, the actuating lever including a pivot portion and a reversible handle having a straight segment and an angled segment, wherein the reversible handle is removably connected to the pivot portion and is securable to the pivot portion in a first orientation in which the angled segment extends in a first direction and is securable to the pivot portion in a second orientation opposite the first orientation.

13. The strapping machine in accordance with claim 12 wherein the reversible handle is secured to the pivot portion by fasteners.

14. A variable strap width accommodating assembly for a strapping machine for forming a seal between two portions of strapping material, the strapping machine having a body carrying a fixed support and a movable support, the strapping machine configured to receive the strapping material between the fixed and movable supports, the variable strap width accommodating assembly, comprising:

an outside guide including first and second guide elements pivotally connected to one another, the outside guide being removably connected to the strapping machine body, the first and second guide elements having different thicknesses relative to a plane defined generally by the strapping material between the fixed and movable supports, the first and second guide elements configured so that one of the first and second guide elements is positioned in a depending orientation relative to the other of the guide elements; and an inside guide mounted to the strapping machine body intersecting the strapping material plane, wherein the one of the first and second guide elements in a depending orientation is moveable into the strapping material plane to abut the strapping material and position the strapping material between the inside and outside guides when the movable support is moved toward the fixed support for forming the seal.

15. The strapping machine in accordance with claim 14 wherein the outside guide first and second guide elements are pivotally mounted to one another by a pivot pin and wherein the outside guide is mounted to the strapping machine body by the pivot pin.

16. The strapping machine in accordance with claim 14 wherein the other of the first and second guide elements is in a longitudinal orientation relative to the guide element in the depending orientation, and wherein the longitudinally oriented guide element is further mounted to the strapping machine body.

17. The strapping machine in accordance with claim 16 wherein the further mounting includes a pin connecting the longitudinal guide element to the strapping machine body.

18. The strapping machine in accordance with claim 14 wherein the inside guide defines first and second guide edges and is connected to the strapping machine body at a point of connection, the point of connection being a first distance from the first guide edge and a second distance from the second guide edge, the first and second distances being different from one another.

19. The strapping machine in accordance with claim 18 including an aperture formed in the inside guide and a bore formed in the strapping machine body at the point of connection, the inside guide bore and strapping machine body bore configured to receive a fastener for securing the inside guide to the strapping machine body.

20. The strapping machine in accordance with claim 18 wherein the inside and outside guides are independently positionable on the strapping machine body to accommodate at least three different strapping material widths.

* * * * *